United States Patent [19]

Kobayashi

[11] Patent Number: 4,893,579

[45] Date of Patent: Jan. 16, 1990

[54] COMPACT PLANING TYPE BOAT

[75] Inventor: Noboru Kobayashi, Iwata, Japan

[73] Assignee: Yamaha Hatsudoki Kabushiki Kaisha, Iwata, Japan

[21] Appl. No.: 237,505

[22] Filed: Aug. 26, 1988

[30] Foreign Application Priority Data

Aug. 28, 1987 [JP] Japan ..... 62-213010

[51] Int. Cl.[4] ..... B63B 35/86

[52] U.S. Cl. ..... 114/363; 114/270; 297/195

[58] Field of Search ..... 114/343, 361, 362, 363, 114/355, 356, 357, 270; 440/38; 297/195, 214

[56] References Cited

U.S. PATENT DOCUMENTS 3,483,844 12/1969 Trautwein ..... 114/270
4,128,072 12/1978 Wood, Jr. ..... 114/291
4,341,177 3/1980 Miyazaki et al. ..... 114/125

FOREIGN PATENT DOCUMENTS 0201326 12/1986 European Pat. Off. .
0291292 12/1986 Japan ..... 114/363

OTHER PUBLICATIONS

Architecture of Planing Hulls/Notes and Examples in Naval Architecture Principles of Naval Architecture.

*Primary Examiner*—Joseph F. Peters, Jr.
*Assistant Examiner*—Edwin L. Swinehart

[57] ABSTRACT

A hull configuration for a small watercraft that provides a tandem straddle type seating arrangement to the rear of a bridge on which the steering handle is formed. In addition, a forward seat is also provided and the hull is configured so that the buoyancy increases if a rider shifts to the forward seat so as to maintain a generally horizontal stability for the watercraft under all conditions.

7 Claims, 5 Drawing Sheets

COMPACT PLANING TYPE BOAT

BACKGROUND OF THE INVENTION

This invention relates to a compact planing type boat and more particularly to a high performance watercraft that is highly versatile.

There recently has been a great degree of popularity in a compact planing type of boat in which the driver and his passenger sit in straddle, tandem fashion upon a set that is positioned directly behind the steering tiller. This form of watercraft is commonly powered by a jet propulsion unit and has very sporting type performance. Although this type of watercraft is excellent for sport riding, the tandem seating position does not offer particular utility for other pleasure activities such as fishing or the like. In addition, the hull configuration of this type of watercraft is such that when there is any substantial forward weight bias, such as if a rider wishes to sit in front of the steering tiller, or, alternatively, if the watercraft is entered or exited from the front, the stability of the watercraft decreases significantly.

It is, therefore, a principal object of this invention to provide an improved compact planing type of watercraft.

It is a further object of this invention to provide a compact planing type of watercraft of this general type which will offer wider versatility then conventional watercraft of this type.

It is a further object of this invention to provide an improved hull configuration for this type of watercraft wherein the watercraft has its versatility substantially increased.

It is a further object of this invention to provide a hull for a watercraft of this type that facilitates riders sitting in either tandem fashion or in fore and aft fashion relative to the steering tiller.

SUMMARY OF THE INVENTION

This invention is adapted to be embodied in a hull configuration for a watercraft having a bow portion, an intermediate bridge portion, supporting means for steering the watercraft and a stern portion. Means provide a rear seat seating at least two riders in the stern portion in straddle, tandem relationship to the rear of the bridge so that the forwardmost rider may steer the watercraft. Means provide a forward seat for at least one of the riders in the bow portion forwardly of the bridge. The unladen center of gravity of the hull is juxtaposed in a longitudinal direction in proximity to the bridge. The hull is configured so that the hull assumes a generally upwardly inclined position when riders are seated in tandem fashion on the rear seat and the hull is travelling forwardly at speed. The hull further is configured to assume a substantially horizontal condition when the watercraft is not travelling and riders of approximately equal weight are seated respectively on the forward and rear seats at approximately equal distances from the bridge.

DETAILED DESCRIPTION OF THE PREFERRED EMBODIMENT OF THE INVENTION

Figure 1:
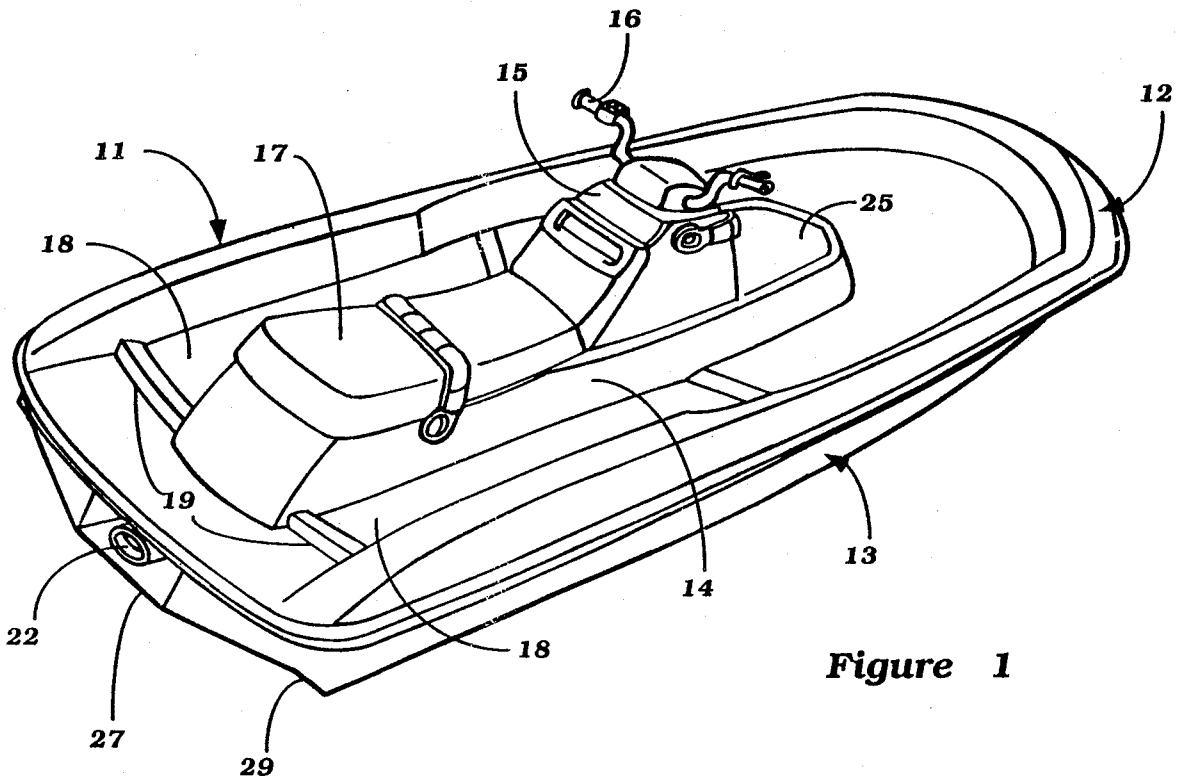
FIG. 1 is a perspective view of a small watercraft constructed in accordance with an embodiment of the invention, viewed from above and from the rear.
Figure 2:
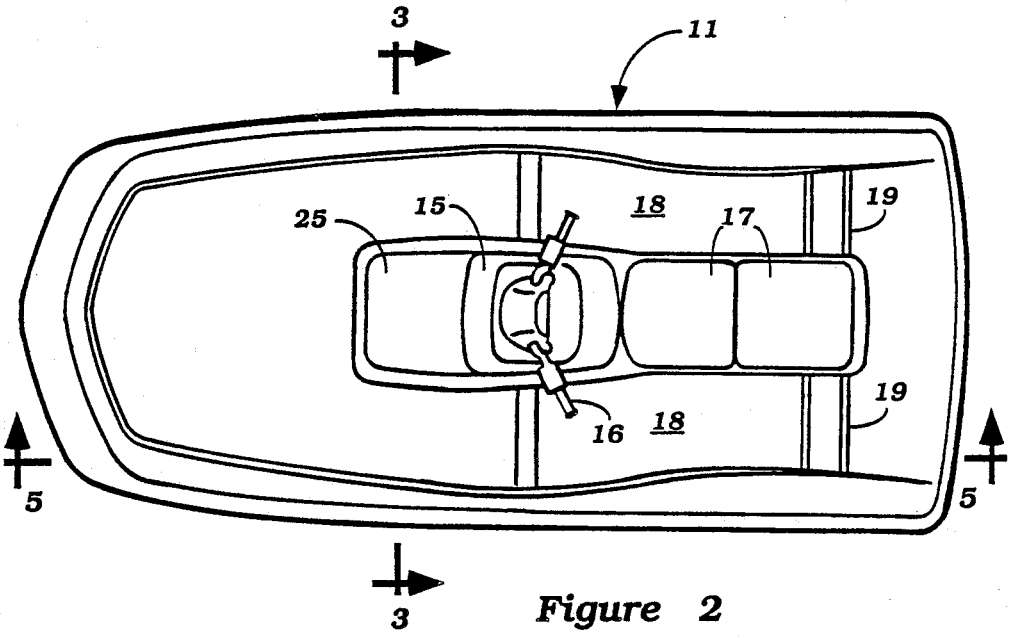
FIG. 2 is a reduced scale, top elevational view of the watercraft.

Referring now in detail to the drawings, a small watercraft constructed in accordance with an embodiment of the invention is identified generally by the reference numeral 11. The watercraft 11 is comprised of a hull, which may be formed from molded fiberglass or the like and which is comprised primarily of an upper hull portion, indicated generally at 12 and a lower hull portion, indicated generally at 13. The hull portions 12 and 13 are affixed to each other in any suitable manner. In addition, certain hollow areas of the hull may be filled with buoyancy material so as to provide the desired buoyancy and the flotation characteristics, in combination with the hull configuration, as will be hereinafter described.

The upper hull portion 12 is provide with a raised central area 14 which also defines a centrally positioned bridge 15. The bridge 15 extends upwardly from the remainder of the portion 14 and accommodates a steering handle 16 for steering the watercraft in a manner to be described.

Figure 5:
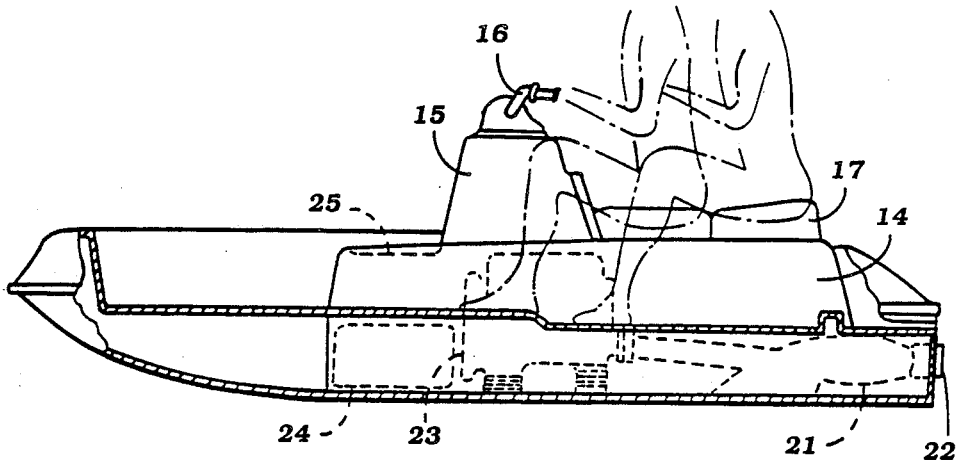
FIG. 5 is cross-sectional view taken along the line 5—5 of FIG. 2 showing two riders seated in tandem fashion on the rear seat.
Figure 8:
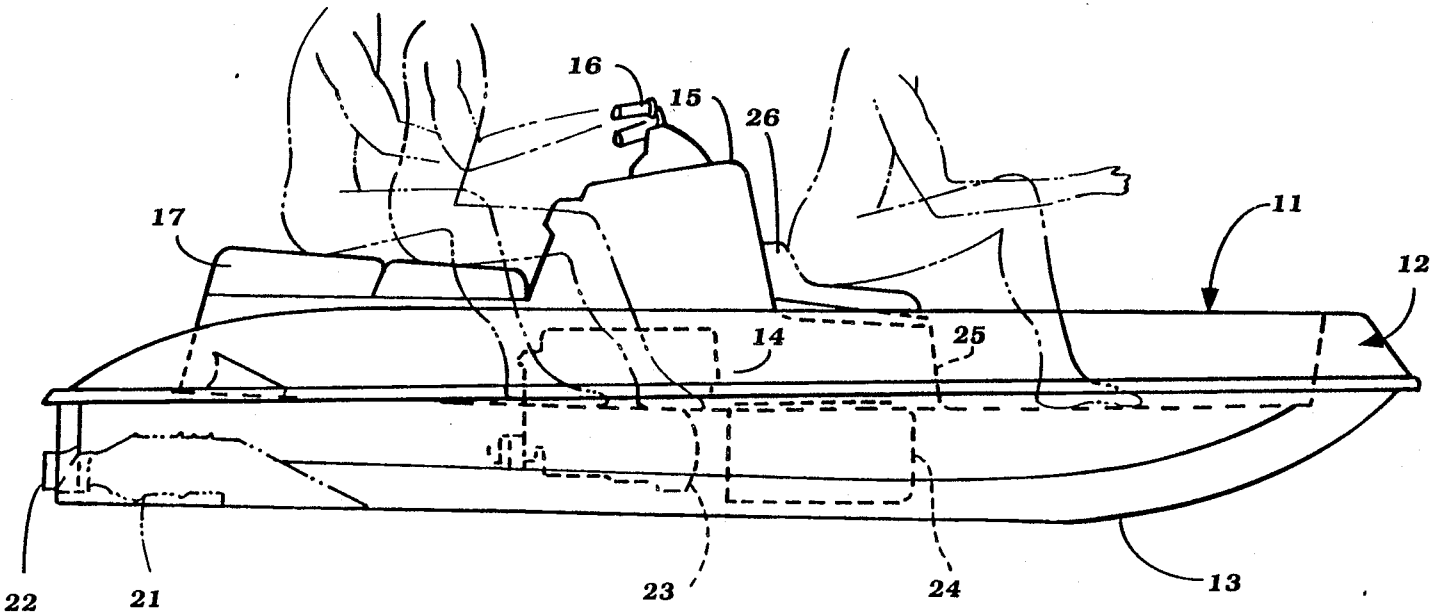
FIG. 8 is an enlarged side elevational view showing the configuration of the watercraft and its angle in the water under a variety of conditions.

Rearwardly of the bridge 15, the raised hull portion 15 accommodates a seat 17 that is designed so as to accommodate a pair of riders seated in straddle, tandem fashion as best shown in FIGS. 5 and 8. On opposite sides of the seat 17, the hull upper portion 12 is provided with a pair of longitudinally extending depressed footwell areas 18 into which the riders may place their legs when so seated on the seat 17. Rearwardly of the footwell portions 18 there is provided a pair of transversely extending ribs 19 which serve the primary function of preventing the intrusion of water into the footwell area 18.

In the illustrated embodiment, the watercraft 11 is of the jet propelled type and for this purpose a jet propulsion unit 21 is disposed in a recess formed in the underside rear portion of the lower hull portion 13. The jet propulsion unit 21 may be of any known type and has a pivotally supported discharge nozzle 22 that is adapted to be steered by the steering handle 16 for steering the watercraft 11 in a known manner. An engine, shown in phantom and which may of any type, is identified generally by the reference numeral 23 and is positioned forwardly in the hull in a position generally beneath the bridge portion 15. The engine 23 drives the jet propulsion unit 21 in any known manner. In addition, a fuel tank and battery assemblage, indicated generally by the reference numeral 24 may be positioned in the hull forwardly of the engine 23 and below a forward seat portion 25 defined by the raised upper hull portion 14. A removable hatch (not shown) may be carried by the portion 25 so as to permit access to the engine 23, fuel tank and battery 24 and for other servicing functions. A seat cushion 26 (FIGS. 6 and 8) can be removably supported on the portion 25 so as to afford a comfortable seating position for a rider forwardly of the bridge 15 under certain circumstances, as will be described.

It should be noted that the configuration of the hull, its buoyancy and the location of the principal mass units is such so that the center of gravity CG is located longitudinally of the watercraft in the position of the bridge 15 and just slightly rearwardly of the steering handle 16 when the watercraft is not mounted by any riders. The center of gravity is also positioned on a longitudinal center line CL of the watercraft. The reasons for this will become apparent as the description proceeds.

Figure 3:
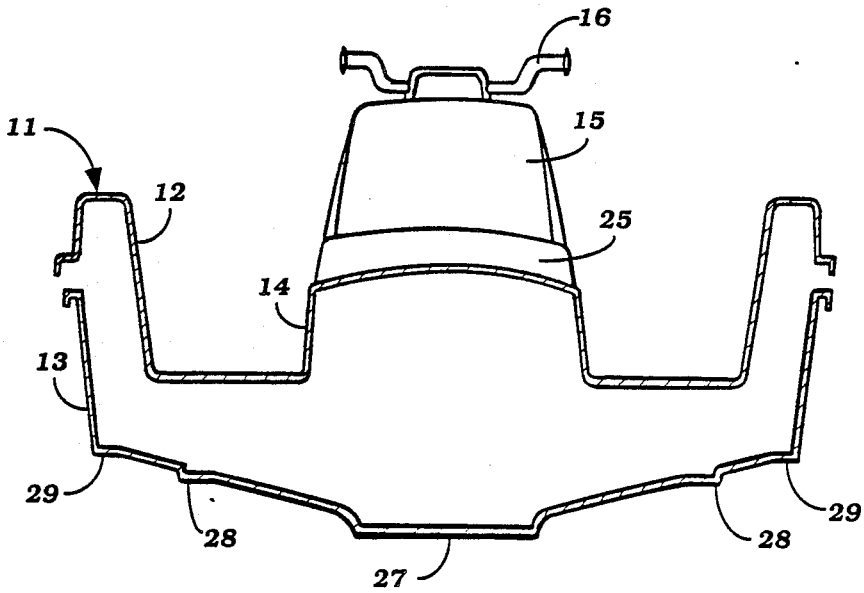
FIG. 3 is an enlarged cross-sectional view taken along the line 4—4 of the watercraft.
Figure 4:
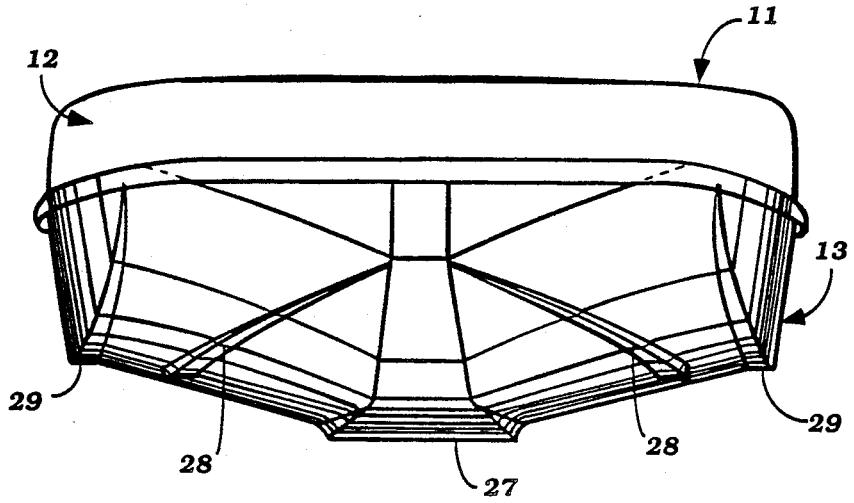
FIG. 4 is an enlarged front elevational view of the watercraft showing primarily the bow portion and hull configuration in this area.

The configuration of the hull is such that it has a relatively broad keel that extends along a base line BL from the rear of the watercraft forwardly to a point approximately midway between the front of the bow and the vertical center line VL. From there, the hull curves upwardly but it has a generally shallow V configuration as best shown in FIG. 3. The central portion of the hull is generally flat as indicated at 27 and then the sides incline upwardly at the shallow V angle and a pair of stripes 28 are formed outwardly that extend in a generally longitudinal direction along the rear and front portions of the hull until the hull begins its upward curvature. At this point, the stripes 28 curve inwardly as best shown in FIG. 4. In addition, the outer edges of the hull are provided with a pair of chines 29 that serve the function of providing stability and resistance to large degrees of leaning under extreme conditions. The stripes 28 on the other hand, function to assist in steering under condition as will now be described.

Figure 7:
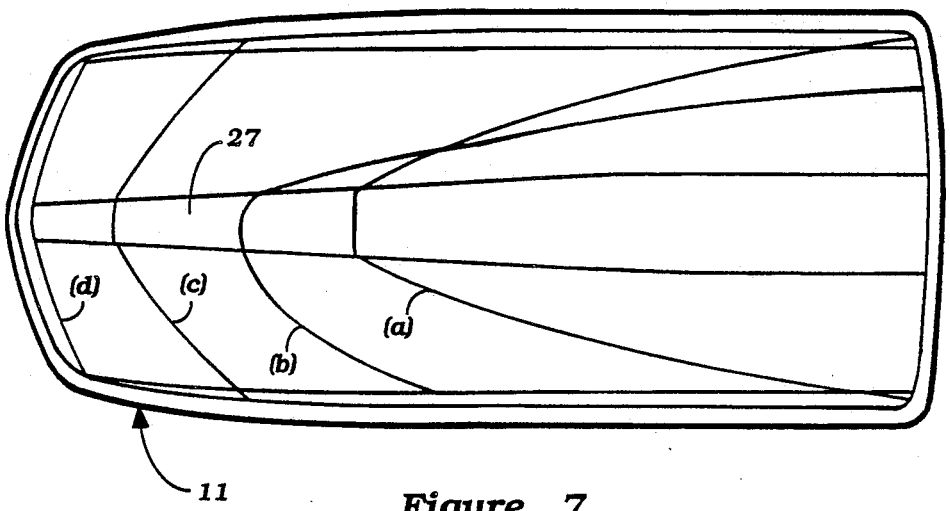
FIG. 7 is a bottom plan view of the watercraft showing the contact patches of the hull with the water under various riding conditions.

FIG. 5 shows the normal condition of the watercraft when travelling at speed. In this condition, the two riders are seated in tandem fashion on the rear seat 17 behind the bridge 15. The forwardmost rider has access to the steering tiller 16 for steering of the watercraft in the aforedescribed manner. When operating under this condition, the center of gravity (CG) moves rearwardly to the point shown in FIG. 7 and the hull will be in a planing condition wherein the water patch contact with the lower portion of the hull is indicated by the line a. This offers good high speed running stability and maneuverability. If desired, the steering of the watercraft, particularly under sharp turn conditions, may be improved by the riders leaning forwardly and into the direction of the turn. The contact patch with the water will then assume the conditions shown by the line b and the stripes 28 will assist in sharp turning.

In FIG. 8 the water level during planing conditions is indicated by the line a and it will be seen that under this condition there is a relatively shallow draft and very little of the forward or bow portion of the hull is in contact with the water so that high speeds are possible while maintaining stability and good handling, as aforenoted.

In the event forward travel is stopped, the watercraft will sink down into the water to some extent and assume a condition as shown by the line c wherein the watercraft is slightly more submerged to the rear than to the front. The contact patch 1*c* shows how the water contacts the hull under this condition. It should be noted that the shallow V angle tends to cause the buoyancy of the forward portion of the hull to increase as the watercraft settles into the water so as to prevent nosediving of the boat under this condition.

Figure 6:
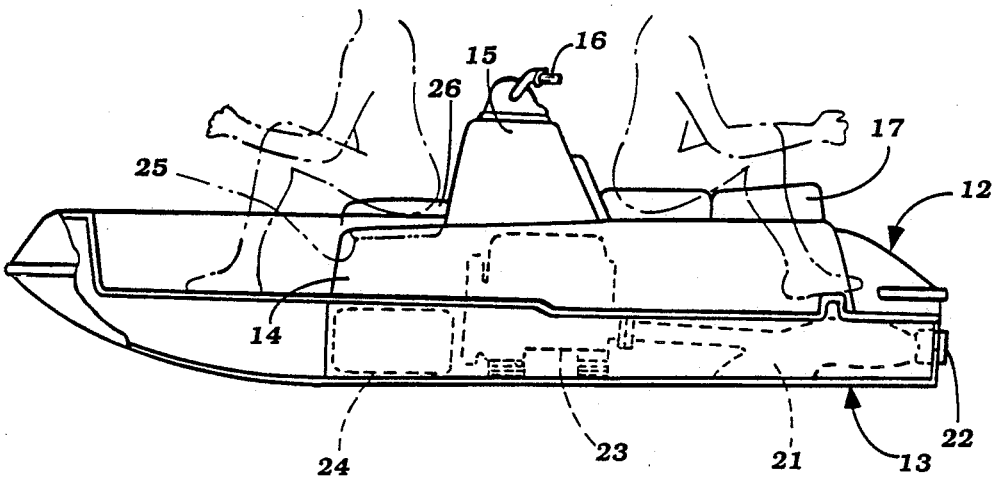
FIG. 6 is a side elevational view, with portions broken away, similar to FIG. 5 but showing one rider seated on the rear seat and one rider seated on the front seat.

In the event a rider wishes to sit in the forward portion of the boat, for example for fishing, he may transfer to the forward seat 26 as shown in FIG. 6. Assuming that both riders have approximately equal weight, the watercraft will assume a very balanced condition relative to the center of gravity because the seat 26 and the forward portion of the rear seat 17 are disposed at the same distances $\frac{1}{2}$ from the center of gravity. Under this condition, the watercraft will assume nearly a horizontal condition as shown by the line d in FIGS. 7 and 8 and very high stability will result. This also assists in dismounting of the watercraft from the front without having the front portion become submerged.

It should be readily apparent, therefore, that the described hull configuration and seating configuration add significantly to the stability of the watercraft under a wide variety of conditions without adversely affecting high speed performance. Although an embodiment of the invention has been illustrated and described, it is to be understood that this is only a preferred embodiment and that various changes and modifications may be made without departing from the spirit and scope of the invention, as defined by the appended claims.

I claim:

1. A hull configuration for a watercraft having a bow portion, an intermediate bridge portion, supporting means for steering said watercraft, and a stern portion, a rear seat for seating at least two riders in said stern portion in straddle, tandem relationship to the rear of said bridge portion so that the forwardmost rider may steer said watercraft, and a forward seat for one of said riders in said bow portion forwardly of said bridge portion, a depressed foot area around a front portion and side portions of said forward seat and side portions of the rear seat and said bridge portion for placement of the riders feet, the unladen center of gravity of said hull being juxtaposed in a longitudinal direction in proximity to said bridge, said hull being configured such that said hull assumes a generally upwardly inclined position when riders are seated in tandem on said rear seat and said hull is travelling forwardly at speed and in a substantially horizontal condition when said watercraft is not travelling and riders of approximately equal weight are seated respectively on said forward and rear seats at approximately equal distances from said bridge.

2. A hull configuration for a watercraft as set forth in claim 1 wherein the forward portion of the hull shape is configured to provide substantially increasing buoyancy as the forward portion of the hull is urged to a submerged position.

3. A hull configuration for a watercraft as set forth in claim 2 wherein the hull is formed with a pair of longitudinally extending stripes that extend parallel to the longitudinal center line of the watercraft on opposite sides thereof from the stern forwardly of the bridge portion and wherein they curve inwardly toward the center line as approaching the bow.

4. A hull configuration for a watercraft as set forth in claim 3 wherein the outer portion of the hull is provided with a pair of chines that have a configuration generally paralleling that of the stripes.

5. A hull configuration for a watercraft as set forth in claim 4 wherein the forward portion of the hull has a generally shallow V shaped configuration.

6. A hull configuration for a watercraft as set forth in claim 1 wherein the watercraft is powered by an engine disposed beneath the bridge portion so as to concentrate the center of gravity in the area of the bridge portion.

7. A hull configuration for a watercraft as set forth in claim 6 further including buoyant mass means formed at the sides of the hull.

* * * * *